US008070256B2

(12) United States Patent
Sudo

(10) Patent No.: US 8,070,256 B2
(45) Date of Patent: Dec. 6, 2011

(54) INK JET HEAD

(75) Inventor: Naoki Sudo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 148 days.

(21) Appl. No.: 11/959,312

(22) Filed: Dec. 18, 2007

(65) Prior Publication Data

US 2008/0151001 A1 Jun. 26, 2008

(30) Foreign Application Priority Data

Dec. 20, 2006 (JP) ..... 2006-343138

(51) Int. Cl.
*B41J 2/21* (2006.01)

(52) U.S. Cl. ..... 347/43

(58) Field of Classification Search ..... 347/12–15, 347/40–43

See application file for complete search history.

(56) References Cited

U.S. PATENT DOCUMENTS

| | | | | |
|---|---|---|---|---|
| 5,376,958 | A * | 12/1994 | Richtsmeier et al. | 347/104 |
| 6,533,392 | B1 * | 3/2003 | Koitabashi | 347/43 |
| 6,688,727 | B2 * | 2/2004 | Otsuki | 347/41 |

FOREIGN PATENT DOCUMENTS

| | | |
|---|---|---|
| JP | 11-028827 | 2/1999 |
| JP | 2001-162841 | 6/2001 |
| JP | 2001-328281 | 11/2001 |
| JP | 2004-106522 | 4/2004 |
| JP | 2005-246643 | 9/2005 |
| JP | 2006-089735 | 4/2006 |

* cited by examiner

*Primary Examiner* — Lamson Nguyen
(74) *Attorney, Agent, or Firm* — Workman Nydegger

(57) ABSTRACT

An ink jet head includes (A) a first black nozzle column having a plurality of nozzles arranged at a predetermined pitch in a transportation direction of a medium and discharging black ink, (B) a second black nozzle column having a plurality of nozzles arranged at the predetermined pitch in the transportation direction and located at positions shifted from the plurality of nozzles of the first black nozzle column in the transportation direction and discharging the black ink, and (C) a color nozzle column having a plurality of nozzles arranged at the predetermined pitch in the transportation direction and located at the same positions as the plurality of nozzles of the second black nozzle column in the transportation direction and discharging different colors of ink from different groups of nozzles thereof, each group including a predetermined number of nozzles consecutively disposed in the transportation direction.

10 Claims, 8 Drawing Sheets

INK JET HEAD

BACKGROUND

1. Technical Field

The present invention relates to an ink jet head.

2. Related Art

JP-A-2001-328281 discloses an ink jet head (hereinafter, simply called head) which has a black nozzle column discharging black ink and a color nozzle column discharging color ink and which performs color printing using black ink and color ink. The document further discloses a printer having the head.

The head disclosed in the document includes one black nozzle column discharging black ink and one color nozzle column discharging color ink. The color nozzle column includes a cyan nozzle block including a plurality of nozzles which discharges cyan ink, a magenta nozzle block including a plurality of nozzles which discharges magenta ink, and a yellow nozzle block including a plurality of nozzles which discharges yellow ink.

So-called bidirectional printing is effective for the case of forming dots spaced apart from each other at a pitch smaller than a nozzle pitch (a distance between neighboring nozzles) in a transportation direction of paper using a head having such a structure. This is because it is possible to print an image at high speed. The bidirectional printing means a printing method in which the head discharges ink while it travels in both the forward travel direction and the return travel direction.

However, the bidirectional printing has a problem in that positional misalignment between inks discharged from the head traveling in the forward travel direction and from the head traveling in the return travel direction is caused in the head traveling direction. That is, there is the probability that positions of formed dots are shifted in the head traveling direction. In this case, the positional misalignment of the dots significantly affects the quality of a picture according to kinds of images. Particularly, in the case of a text image and a line image printed in black, the positional misalignment of dots can lead to saccadic letters or lines. For such a reason, the misalignment of dots significantly affects the quality of a picture.

SUMMARY

An advantage of some aspects of the invention is that it provides an ink jet head which is capable of reducing misalignment of dots formed by black ink.

According to one aspect of the invention, there is provided an ink jet head including (A) a first black nozzle column having a plurality of nozzles arranged at a predetermined pitch in a transportation direction of a medium and discharging black ink, (B) a second black nozzle column having a plurality of nozzles arranged at the predetermined pitch in the transportation direction and located at positions shifted from the plurality of nozzles of the first black nozzle column in the transportation direction and discharging the black ink, and (C) a color nozzle column having a plurality of nozzles arranged at the predetermined pitch in the transportation direction and located at the same positions as the plurality of nozzles of the second black nozzle column in the transportation direction and discharging different colors of ink from different groups of nozzles thereof, each group including a predetermined number of nozzles consecutively disposed in the transportation direction.

Other features of the invention will be apparent from description of the specification and illustration of the accompanying drawings.

BRIEF DESCRIPTION OF THE DRAWINGS

Hereinafter, embodiments of the invention will be described with reference to the accompanying drawings.

DESCRIPTION OF EXEMPLARY EMBODIMENTS

Figure 1:
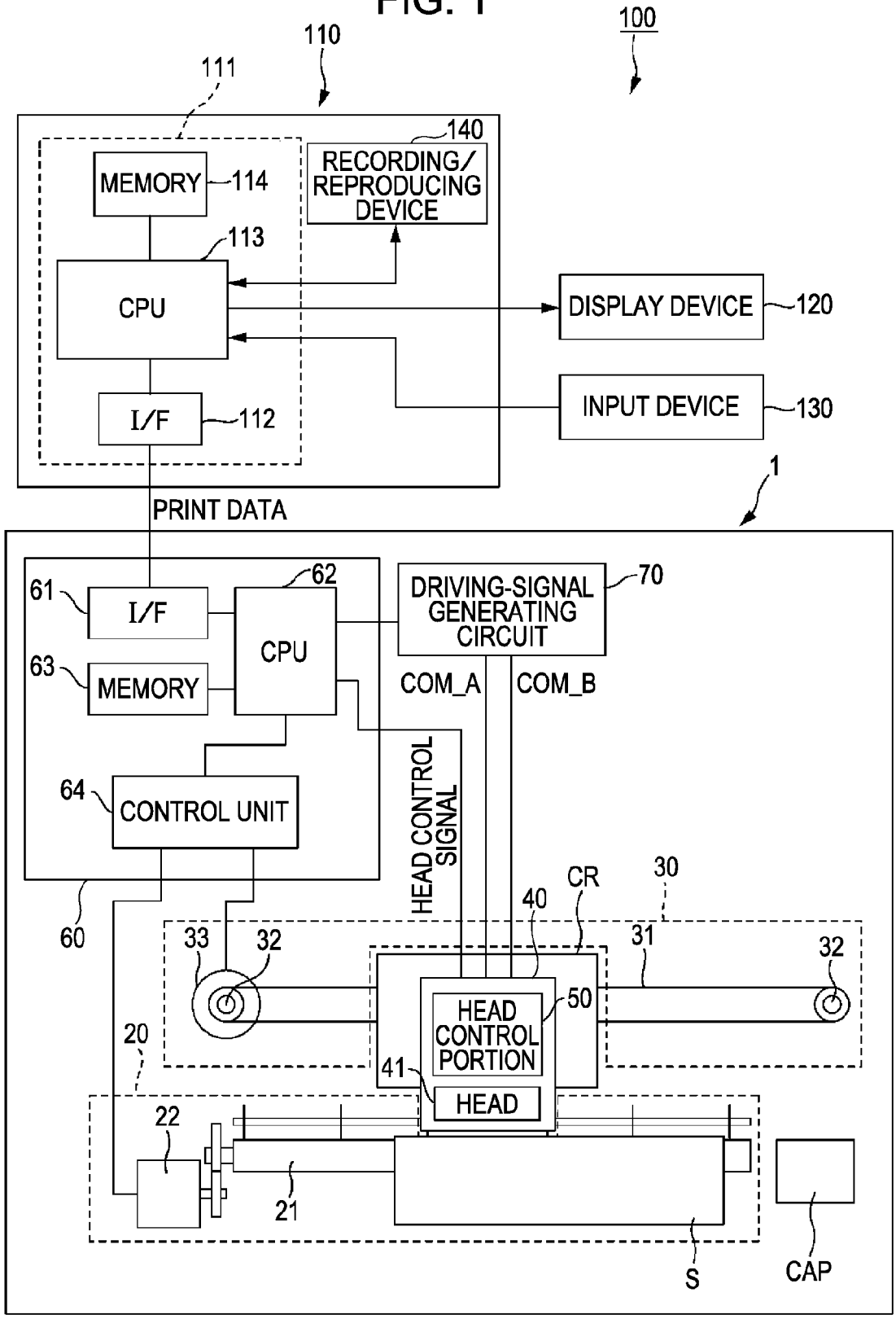
FIG. 1 is a block diagram illustrating a structure of a printing system.

At least the following will be apparent from description of the specification and illustration of the accompanying drawings.

That is, it is possible to realize an ink jet head including (A) a first black nozzle column having a plurality of nozzles arranged at a predetermined pitch in a transportation direction of a medium and discharging black ink, (B) a second black nozzle column having a plurality of nozzles arranged at the predetermined pitch in the transportation direction and located at positions shifted from the plurality of nozzles of the first black nozzle column in the transportation direction and discharging the black ink, and (C) a color nozzle column having a plurality of nozzles arranged at the predetermined pitch in the transportation direction and located at the same positions as the plurality of nozzles of the second black nozzle column in the transportation direction and discharging different colors of ink from different groups of nozzles thereof, each group including a predetermined number of nozzles consecutively disposed in the transportation direction.

Thanks to the structure, it is possible to form dots of black ink while the head travels in one direction by employing the first black nozzle column and the second black nozzle column. Thus, it is possible to suppress the positional misalignment of dots of black ink.

In the ink jet head, it is preferable that the plurality of nozzles of the second black nozzle column are formed at positions shifted from the plurality of nozzles of the first black nozzle column by a distance corresponding to the half of the predetermined pitch in the transportation direction.

Thanks to the use of the first black nozzle column and the second black nozzle column, it is possible to improve print resolution by two times and control becomes easier.

In the ink jet head, it is preferable that each of the black nozzle columns includes a cyan group discharging cyan ink, a magenta group discharging magenta ink, and a yellow group discharging yellow ink. It is further preferable that each of the magenta group and the yellow group includes the same number of nozzles as the cyan group.

Thanks to the structure, it is possible to perform color printing with a smaller number of nozzle columns.

In the ink jet head, it is preferable that the cyan group is disposed on the upstream side in the transportation direction with respect to the magenta and yellow group. Further, it is also preferable that the yellow group is disposed on the downstream side in the transportation direction with respect to the cyan and magenta groups.

Thanks to the structure, it is possible to form dots of magenta ink and dots of yellow ink after forming dots of cyan ink. Further, it is possible to form the dots of yellow ink at the last. As a result, it is possible to improve the quality of a picture.

In the ink jet head, it is preferable that the plurality of nozzles of the second black nozzle column are formed at positions shifted from the plurality of nozzles of the first black nozzle column in a transverse direction perpendicular to the transportation direction by a distance corresponding to an integer multiple of printing resolution.

Thanks to such a structure, it is possible to enable the first black nozzle column and the second black nozzle column to simultaneously discharge ink, which leads to easy control of ink-discharging.

In the ink jet head, it is preferable that the plurality of nozzles of the color nozzle column is formed at positions shifted from the plurality of nozzles of the second black ink nozzle column by a distance corresponding to an integer multiple of print resolution in a transverse direction perpendicular to the transportation direction.

Thanks to the structure, it is possible to enable the second black nozzle column and the color nozzle column to simultaneously discharge ink, which leads to easy control of ink-discharging.

In the ink jet head, it is preferable that the plurality of nozzles of the second black nozzle column are formed at positions shifted from the plurality of nozzles of the first black nozzle column by a distance corresponding to an integer multiple of print resolution in a transverse direction perpendicular to the transportation direction, and the plurality of nozzles of the color nozzle column is formed at positions shifted from the plurality of nozzles of the second black nozzle column by a distance which corresponds to an integer multiple of print resolution and which is larger than a distance between the plurality of nozzles of the first black nozzle column and the plurality of nozzles of the second black nozzle column in the transverse direction.

Thanks to the structure, it is possible to enable the first black nozzle column, the second black nozzle column, and the color nozzle column simultaneously discharge ink, which leads to easy control of ink-discharging. Further, it is possible to suppress color mixture between black ink and color ink.

According to another aspect of the invention, there is provided a printing method includes (A) a first ink-discharging process of causing a head, which has a black nozzle block including a plurality of nozzles arranged at a first predetermined pitch in a transportation direction of a medium and a color nozzle block including a plurality of nozzles arranged at a second predetermined pitch different from the first predetermined pitch in the transportation direction, to discharge ink form the nozzles thereof while moving the head travel in a first direction intersecting the transportation direction of the medium, in which black ink is discharged from the plurality of nozzles of the black nozzle block and color ink is discharged from the plurality of nozzles of the color nozzle block, (B) a transporting process of transporting the medium such that relative positions of the plurality of nozzles of the color nozzle block with respect to the medium are shifted in the transportation direction, and (C) a second ink-discharging process of causing the head to discharge ink form the nozzles thereof while moving the head in a second direction which is opposite the first direction, in which the black ink is discharged from the plurality of nozzles of the black nozzle block and the color ink is discharged from the plurality of nozzles of the color nozzle block.

Thanks to the method, dots of the black ink are formed by a first discharge operation of the head when the head travels in the first direction. Accordingly, it is possible to reduce the positional misalignment of the dots of the black ink. Further, it is possible to form dots of the color ink by the first discharge operation and a second discharge operation of the head. Accordingly, it is possible to form the dots suitable for the uses of the black ink and the color ink.

In the printing method, it is preferable that the medium is transported by a distance shorter than the first predetermined pitch in a transporting process.

Thanks to the method, it is possible to form the dots of the color ink at a pitch smaller than a nozzle pitch.

In the printing method, it is preferable that the second predetermined pitch is an even-number multiple of the first predetermined pitch.

Thanks to the method, it is possible to efficiently form the dots.

In the printing method, it is preferable that the color nozzle block is disposed nearer a home position than the black nozzle block, the first direction is a direction separated from the home position, and the second direction is a direction approaching the home position.

Thanks to the printing method, in the case in which the black ink and the color ink overstrike one position of the medium the color ink lands on top of the black ink. Accordingly, it is possible to regulate the color tone of dots where different colors of ink overstrike.

In the printing method, it is preferable that the color nozzle block includes a plurality of groups each including a predetermined number of nozzles consecutively disposed in the transportation direction, and the nozzles of different groups eject different colors of ink. Further, it is preferable that the color nozzle block includes a cyan group ejecting cyan ink, a magenta group ejecting magenta ink, and a yellow group ejecting yellow ink.

Thanks to the printing method, it is possible to perform color printing with the smaller number of nozzle blocks.

According to a further aspect of the invention, there is provided a printing apparatus including (A) a head having a black nozzle block which includes a plurality of nozzles arranged at a first predetermined pitch in a transportation direction of a medium and a color nozzle block which includes a plurality of nozzles arranged at a second predetermined pitch which is larger than the first predetermined pitch in the transportation direction, (B) a head moving unit moving the head in a first direction intersecting the transportation direction and in a second direction opposite the first direction intersecting the transportation direction, and (C) a medium transporting unit transporting the medium in the transportation direction, and (D) a controller for controlling ink-discharging performed by the head, movement of the head performed by the head moving unit, and transportation of the medium performed by the medium transporting unit, in which the controller controls the head in a manner such that black ink is discharged from the plurality of nozzles of the black nozzle block and color ink is discharged from the plurality of nozzles of the color nozzle block while the head travels in the first direction, and such that the black ink is not discharged from the black nozzle block and the color ink is discharged from the color nozzle block while the head travels in the second direction.

First Embodiment

Structure of Printing System

As shown in FIG. 1, a printing system 100 includes a printer 1, a computer 110, a display device 120, an input device 130, and a recording and reproducing device 140. The printer 1 corresponds to a printing device and prints an image on a recording medium such as paper S, cloth, and film by discharging ink toward the recording medium. The computer 110 is connected to the printer 1 so as to communicate with the printer 1. The computer 110 has computer programs including application programs and printer drivers installed therein. Thus, the computer 110 outputs print data corresponding to an image to the printer 1. The display device 120 is constructed by using a liquid crystal device 120 or the like. The input device 130 is a device used to input information. The recording and reproducing device 140 is a flexible disk drive device.

Structure of Computer 110

The computer 110 includes a host controller 111. The host controller 111 performs a variety of control operations with respect to the computer 110. The display device 120, the input device 130, and the recording and reproducing device 140 are connected to each other so as to communicating with each other. The host controller 111 includes an interface unit 112, a central processing unit (CPU) 113, and a memory 114. The interface unit 112 serves to perform delivery and receipt of data between the host controller 111 and the printer 1. The CPU 113 is an arithmetic processing unit performing overall control of the computer 110. The memory 114 has a storage region for storing computer programs used by the CPU 113 and an operation region. The CPU 113 performs a variety of kinds of controls according to the computer programs stored in the memory 114.

The print data is data in a form that can be interpreted by the printer 1 and includes a variety of kinds of command data and dot formation data. The command data is data for instructing the printer 1 to execute specific operations. The dot formation data is data relating to dots to be formed on the paper S (for example, color and size of dots) and is set for each unit region. The unit region means an imaginary region provided on a medium such as paper S, which has a rectangular shape and corresponds to a region where a dot is to be formed.

Structure of Printer 1

Hereinafter, structure of the printer 1 will be described. The printer 1 includes a paper transporting mechanism 20, a carriage moving mechanism 30, a head unit 40 (head 41, head control portion 50), a printer controller 60, and a driving-signal generating circuit 70.

The paper transporting mechanism 20 serves to feed the medium such as paper S to a position where printing is available or to transport the paper S in the transportation direction. Accordingly, the paper transporting mechanism 20 corresponds to a medium transporting portion which transports the medium in the transportation direction. The paper transporting mechanism 20 includes a transporting motor 22 used to rotate a transporting roller 21. The paper transporting mechanism 20 is not limited to such structure but may employ another structure as long as the structures can transport the paper S.

The carriage moving mechanism 30 serves to move a carriage CR equipped with the head unit 40 in a carriage traveling direction. The carriage traveling direction is a transverse direction intersecting the transportation direction of the paper S and includes a direction from a first side to a second side and a direction from the second side to the first side. In the printer 1, the carriage traveling direction is set to a direction intersecting the transportation direction of the paper S. Further, a direction getting away from a capping member CAP (i.e., home position) is assumed as a first direction, and a direction approaching the capping member CAP is assumed as a second direction.

The provided exemplary carriage moving mechanism 30 includes a timing belt 31 connected to a carriage CR, a pair of pulleys 32 used to advance the timing belt 31, and a driving motor 33 having a shaft engaged with one of the pair of pulleys 32. The head unit 40 includes a head 41 discharging ink. Accordingly, the carriage moving mechanism 30 corresponds to the head moving unit which moves the head 41. The carriage traveling direction corresponds to the head traveling direction in which the head 41 travels. The carriage moving mechanism 30 is not limited to any specific structure but may have a variety of structures as long as the structures can move the carriage CR (head 41).

The head unit 40 includes the head 41 discharging ink toward the paper S and the head control portion 50 controlling operations of the head 41. The head 41 includes piezoelectric elements (not shown) which are a kind of driving elements, and the head discharges ink from the nozzles thereof by deformation of the piezoelectric elements. The head 41 will be described in more detail later. The head control portion 50 applies necessary part of driving-signals COM_A and COM_B generated by the driving-signal generating circuit 70 based on a head control signal from the printer controller 60 to the piezoelectric elements. The piezoelectric elements are deformed in response to the applied part of the driving-signals.

The printer controller 60 controls every element of the printer 1. For example, the printer controller 60 controls the paper transporting mechanism 20, the carriage moving mechanism 30, the head 41, the head control portion 50, and the driving-signal generating circuit 70. The printer controller 60 includes an interface unit 61, a CPU 62, a memory 63, and a control unit 64. The interface unit 61 performs data delivery and receipt with the computer 110. The CPU 62 is an arithmetic processing device used to control overall operation of the printer 1. The memory 63 has a storage region for storing programs used by the CPU 62 and an operation region. The CPU 62 controls operations of control objects according to the computer programs stored in the memory 63. For example, the CPU 62 controls the paper transporting mechanism 20 and the carriage moving mechanism 30 through the control unit 64. The CPU 62 outputs a head control signal to the head control portion 50 for controlling the operation of the head 41 and a control signal to the driving-signal generating circuit 70 for generating a driving-signal. The control signal is called a DAC value and corresponds to waveform information determining the waveform of the driving-signal. Further, the printer controller 60 and the head control portion 50 form a controller controlling discharge of ink from the head 41.

The driving-signal generating circuit 70 generates the driving-signal on the basis of the control signal from the printer controller 60. Parts of the driving-signal are selectively applied to the piezoelectric elements. Accordingly, the deformation of the piezoelectric elements, which is caused by the applied part of the driving-signal, leads to discharge of ink from the corresponding nozzles. Head 41

Figure 2:
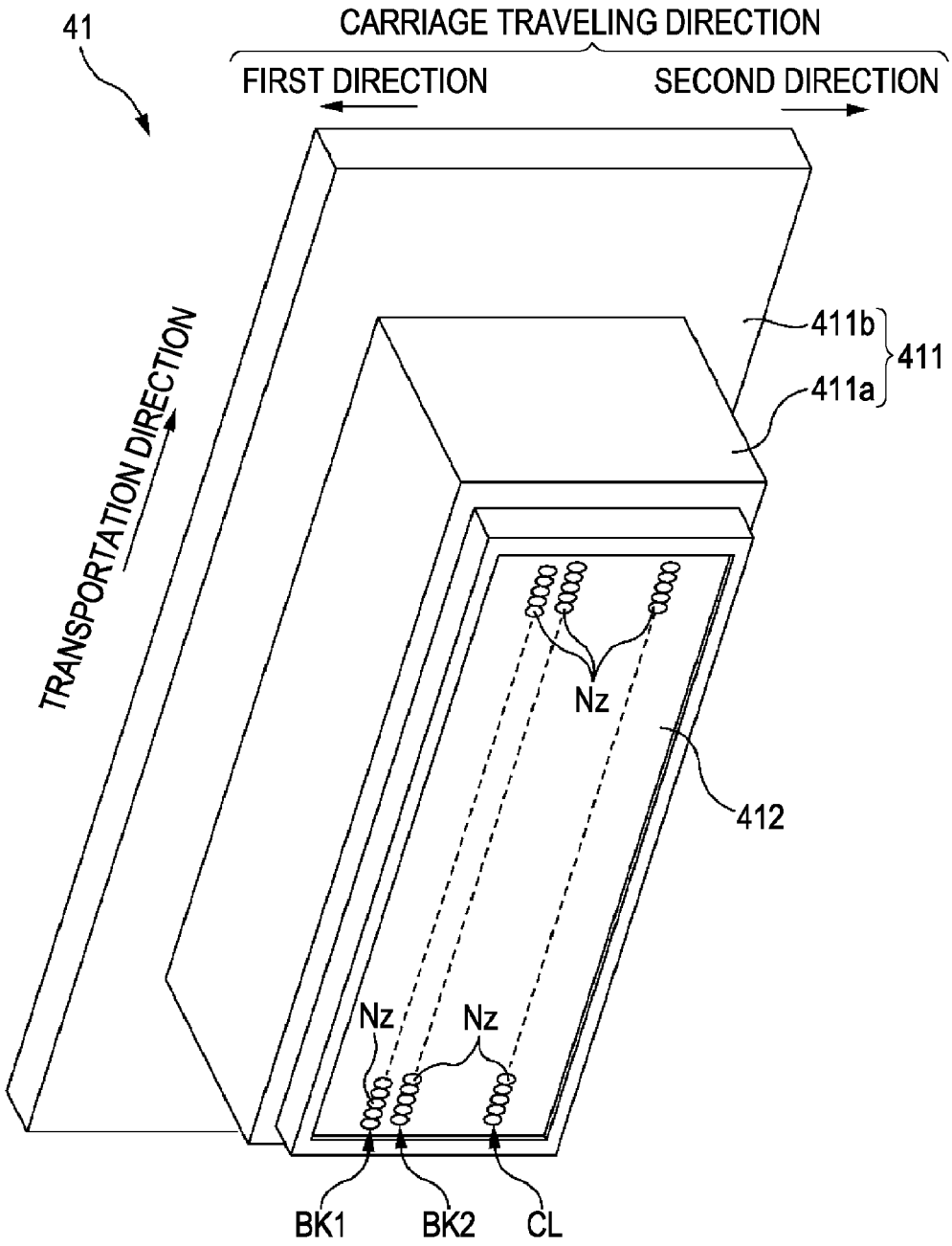
FIG. 2 is a perspective view illustrating a head which is observed from the nozzle side.

As shown in FIG. 2, the head 41 includes a casing 411 and a nozzle plate 412. The casing 411 includes a casing body 411*a* and a flange 411*b*. The casing body 411*a* has a rectangular parallelpiped structure and encases the piezoelectric element. The flange 411*b* is installed so as to protrude from the side surface of a rear anchor portion of the casing body 411*a*. The flange 411*b* is used for attaching the head 41 to the carriage CR. The nozzle plate 412 is attached to the leading end of the casing body 411*a*. The nozzle plate 412 of the head 41 has a rectangular shape and is provided with a plurality of nozzles Nz. The piezoelectric elements are disposed so as to correspond to the nozzles Nz, respectively. That is, the nozzles Nz and the piezoelectric elements are disposed in one to one arrangement. Thanks to the structure, it is possible to individually control the nozzles Nz so as to discharge ink.

Figure 3:
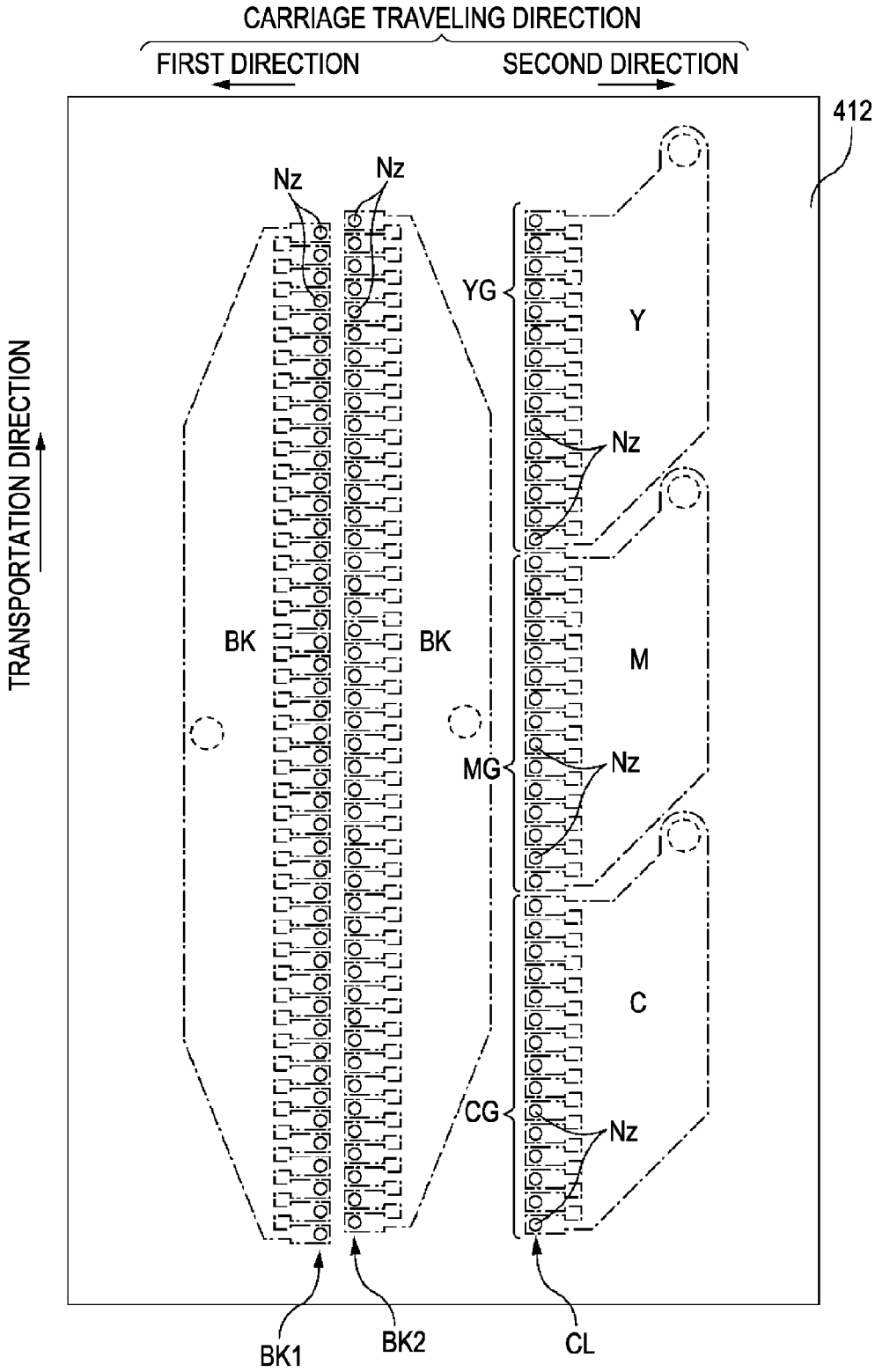
FIG. 3 is a diagram illustrating arrangement of nozzles disposed on a nozzle plate and kinds of ink discharged from the nozzles.

As shown in FIGS. 2 and 3, the nozzle plate 412 has three nozzle columns, each column including a plurality of nozzles Nz. One column of the three nozzle columns is a first black nozzle column BK1 discharging black ink, another one column is a second black nozzle column BK2 discharging black ink, and the remaining column is a color nozzle column CL discharging color ink. Each of the nozzle columns includes a plurality of nozzles Nz arranged at a predetermined pitch. In this embodiment, nozzles of each of the nozzle columns BK1, BK2, and CL are arranged at a pitch of 1/180 inch in the long-side direction of the nozzle plate 41. In FIG. 3, for convenience of illustration, one nozzle column includes 45 nozzles Nz. An attaching direction of the head 41 to the carriage CR is set in a manner such that a nozzle column direction (i.e. a direction in which a plurality of nozzles belonging to the same nozzle column are arranged) is the same as the transportation direction of the paper P. Accordingly, the nozzle column direction corresponds to the transportation direction of the paper S.

Figure 4:
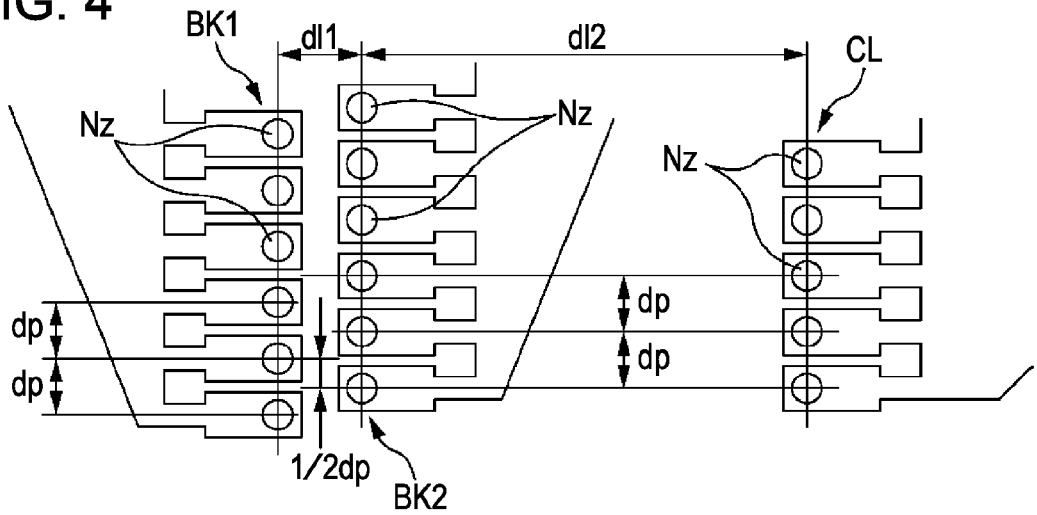
FIG. 4 is a partial enlarged view illustrating the positional relationship of nozzles of nozzle columns.

As shown in FIG. 4, the plurality of nozzles Nz of the second black nozzle column BK2 are formed at positions shifted from the plurality of nozzles of the first black nozzle column BK1 in the long-side direction of the nozzle plate 412 (transportation direction of the paper S). In the head 41, the plurality of the nozzles Nz of the second black nozzle column BK2 are formed at positions shifted from the plurality of nozzles of the first black nozzle column BK1 by a pitch of 1/360 inch. In other words, the plurality of the nozzles Nz of the second black nozzle column BK2 are formed at positions shifted from the plurality of nozzles of the first black nozzle column BK1 by the half of a nozzle pitch dp of the first black nozzle column BK1 when the head 41 is attached to the carriage CR. Thanks to such a structure, the first black nozzle column BK1 is disposed on the upstream side in the transportation direction with respect to the second black nozzle column BK2 by the half of the nozzle pitch of the first black nozzle column BK1. The first black nozzle column BK1 and the second black nozzle column BK2 are disposed with a gap therebetween in a traveling direction of the carriage CR. The plurality of nozzles Nz of the first black nozzle column BK1 and the plurality of nozzles Nz of the second black nozzle column BK2 form a nozzle block (referred to as black nozzle block in convenience of explanation) in which the nozzles Nz are arranged in a zigzag form. Each of the nozzles Nz of the black nozzle block is spaced apart from a neighboring nozzle Nz at a pitch of 1/360 inch in the long-side direction of the nozzle plate 412 (the transportation direction of the paper S). With such a structure, it is possible to form dots at a pitch smaller than the nozzle pitch of the first black nozzle column BK1 and the second black nozzle column BK2 when the nozzles Nz of the black nozzle block discharge ink.

The plurality of nozzles of the color nozzle column CL are formed at the same position as the plurality of nozzles of the second black nozzle column BK2 in the long-side direction of the nozzle plate 412. Further, the second black nozzle column BK2 and the color nozzle column CL have the same nozzle pitch. Accordingly, ink discharged from the second black nozzle column BK2 and ink discharged from the color nozzle column CL strike the same position of the paper S in the transportation direction of the paper S. The plurality of nozzles Nz of the color nozzle column CL is divided into a predetermined number of groups consecutive in the transportation direction of the paper S, and different groups of the nozzles discharge different colors of ink. In greater detail, the color nozzle column CL discharges three kinds of color ink including cyan ink C, magenta ink M, and yellow ink Y. Accordingly, the plurality of nozzles Nz of the color nozzle column CL includes a cyan group CG discharging cyan ink, a magenta group MG discharging magenta ink, and a yellow group YG discharging yellow ink. As described, if the color nozzle column CL includes the cyan group CG, the magenta group MG, and the yellow group YG, and the groups discharge the cyan ink C, the magenta ink M, and the yellow ink Y, respectively, it is possible to perform color printing with a smaller number of color nozzle columns (for example, one color nozzle column CL). Further, since the color nozzle column CL includes 180 nozzles Nz, the plurality of nozzles Nz of the color nozzle column CL are divided into three groups, each group having 60 nozzles. In other words, each of the number of nozzles Nz of the magenta group MG and the number of the nozzles Nz of the yellow group YG equals to the number of nozzle Nz of the cyan group CG. For convenience of illustration, FIG. 3 shows that each group includes 15 nozzles Nz. Thanks to such a structure, it is possible to regulate transportation amount in transporting processes which will be described later (S40, FIG. 5) and the control of printing becomes simpler.

When the head 41 is attached to the carriage CR, the cyan group CG is disposed on the upstream side in the transportation direction of the paper S with respect to the magenta group MG and the yellow group YG. The yellow group YG is disposed on the downstream side in the transportation direction of the paper S with respect to the cyan group CG and the magenta group MG. That is, the groups of the color nozzle column CL are arranged in order of the cyan group CG, the magenta group MG, and the yellow group YG from the upstream side to the downstream side in the transportation direction. This structure is configured in order to provide a sufficient time gap between striking times of the cyan ink C and the yellow ink Y to the paper S, which are significantly affected by color mixture thereof, which will be described later. In addition, the color nozzle column CL is disposed nearer the capping member CAP (i.e. home position) than the black nozzle block (the first black nozzle column BK1 and the second black nozzle column BK2). This is configures in order to make the color ink strike the paper S before the black ink strikes to the paper S in the case in which the black ink and the color ink overstrike the paper S.

Hereinafter, arrangement of the nozzle columns in a short-side direction of the nozzle plate 412 (carriage traveling direction) will be described. In the positional relationship between the first black nozzle column BK1 and the second black nozzle column BK2, the plurality of nozzles Nz of the second black nozzle column BK2 are spaced apart from the plurality of nozzles Nz of the first black nozzle column BK1 in the short-side direction of the nozzle plate 412 by a distance corresponding to an integer multiple of print resolution. Further, in examples shown in FIGS. 7B and 8B, the distance is two times the print resolution. Thanks to such a structure, it is possible to synchronize driving timing of the piezoelectric elements of the nozzles of the second black nozzle column BK2 with driving timing of the piezoelectric elements of the nozzles of the first black nozzle column BK1, and control of printing becomes easier.

Next, with respect to the positional relationship between the second black nozzle column BK2 and the color nozzle column CL, the plurality of nozzles Nz of the color nozzle column CL are spaced apart from the plurality of nozzles Nz of the second black nozzle column BK2 by a distance corresponding to an integer multiple of print resolution in the short-side direction of the nozzle plate 412. Further, in the examples shown in FIGS. 7B and 8B, the distance is five times the print resolution. Thanks to such a structure, it is possible to synchronize driving timing of the piezoelectric elements corresponding to the color nozzle column CL and driving timing of the piezoelectric elements corresponding to the second black nozzle column BK2, and the control of printing becomes easier.

In the head 41, the distance between the plurality of nozzles Nz of the second block nozzle column BK2 and the plurality of nozzles Nz of the color nozzle column CL is set to be larger than that between the plurality of nozzles Nz of the first black nozzle column BK1 and the plurality of nozzles Nz of the second black nozzle column BK2. This structure is configured in order to reduce effect of color mixture with the black ink, which will be described later.

Printing Operation

Hereinafter, a printing operation of the printer 1 having the above described structure will be described. The printer 1 starts to operate by receiving print data from the computer 110. In the printing operation, the printer controller 60 performs a variety of kinds of processing. Each processing which will be described later is performed by a method in which the printer controller 60 executes the computer programs stored in the memory 63. Accordingly, the computer programs have codes which makes the printer controller 60 perform a variety of kinds of processing.

Figure 5:
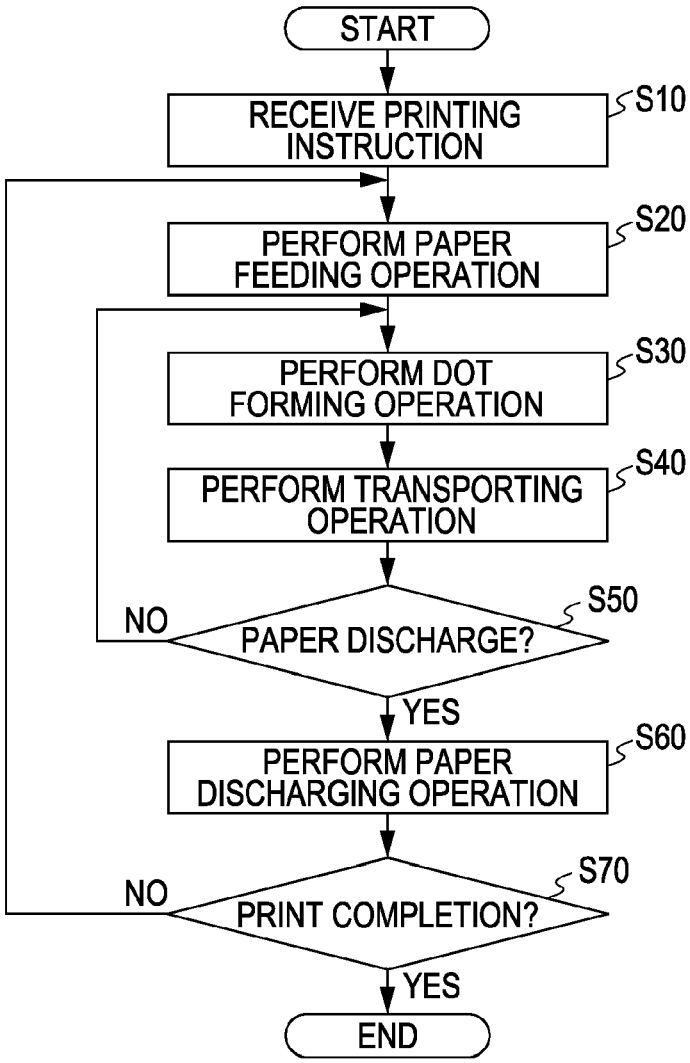
FIG. 5 is a flowchart for explaining printing operation.

As shown in FIG. 5, the printer controller 60 performs a paper feeding operation (S20), a dot forming operation (S30), a transporting operation (S40), a paper discharging determination operation (S50), a paper discharging operation (S60), and a printing stop determination operation (S70) after receiving a printing command of print data (S10).

In the paper feeding operation, the paper S, which is a printing object, is moved and positioned at a printing start position (so-called cuing position). In the paper feeding operation, the printer controller 60 performs a control to drive the transporting motor 22. Thus, the transporting roller 21 is rotated so as to transport the paper S.

The dot forming operation is for forming dots on the paper S. In the dot forming operation, the printer controller 60 performs a control so that a driving motor 33 starts, the driving-signal generating circuit 70 generates a driving-signal, and the head 41 starts to operate. By such controls, the head 41 travels along with the carriage CR and the ink is discharged from the nozzles Nz. Such dot forming operation corresponds to an ink-discharging operation in which ink is discharged from the nozzles Nz while the head 41 travels. In this embodiment, a first ink-discharging operation is performed when the head 41 travels in a first direction getting away from the capping member CAP. The first ink-discharging operation corresponds to a first ink-discharging process. During this first ink-discharging operation, the black nozzle block (the first black nozzle column BK1 and the second black nozzle column BK2) discharges black ink, and the color nozzle block (the color nozzle column CL) discharges color ink. On the other hand, the second ink-discharging operation is performed when the head 41 travels in a second direction approaching the capping member CAP. The second ink-discharging operation corresponds to a second ink-discharging process in which the black nozzle block does not discharge black ink but the color nozzle block discharges color ink.

The transporting operation is for transporting the paper S in the transportation direction and corresponds to a transporting process. During the transporting operation, the printer controller 60 performs a control for driving the transporting motor 22. Thanks to this process, a transporting roller 21 rotates and the paper S is transported in the transportation direction. Thanks to this transporting operation, it is possible to form dots by a current dot forming operation at positions different from (i.e. shifted from) positions of dots formed by the previous dot forming operation (in the transportation direction). In this embodiment, a transportation amount of the transporting operation performed after the first ink-discharging operation but before the second ink-discharging operation (convenience for explanation, referred to as a first transporting operation (first transporting process)) and a transportation amount of the transporting operation performed after the second ink-discharging operation but after the first ink-discharging operation (convenience for explanation, referred to as a second transporting operation (second transporting process)) are different from each other. In the first transporting operation, the paper is transported at a pitch smaller than the nozzle pitch of the color nozzle column CL. Accordingly, it is possible to form dots of color ink at regions where dots of color ink cannot be formed in the first dot forming operation by the second dot forming operation. In the second transporting operation, the paper S is transported by an amount corresponding to the width of each of the cyan group CG, the magenta group MG, and the yellow group YG.

The paper discharging determination operation is for determining if the paper S (a printing object) must be discharged. The paper discharging operation is for discharging the paper S and is performed on the basis of the determination "paper must be discharged" resulting from the paper discharging determination operation. In this paper discharging process, the printer controller 60 controls the transporting motor 22 to start to operate. As a result, the transporting roller 21 rotates and the paper S is discharged. The printing stop determination operation determines whether the printing operation must be stopped or not. In the case in which the result of the printing stop determination operation indicates the state in which the printing is not continuing, the controller 60 stops a series of processes. Conversely, in the case in which the result indicates the state in which the printing is continuing, the printer controller 60 performs the paper feeding operation so as to feed new paper S.

The printing of the image with respect to the paper S is performed by repeatedly performing the dot forming operation and the transporting operation. When the ink discharged from the nozzles Nz lands on and strike the paper S, dots are formed on the paper S. As a result, a dot column including a plurality of dots arranged in the carriage traveling direction is formed. Because the dot forming operation and the transporting operation are repeatedly performed, a plurality of dot columns arranged in the transportation direction is formed on the paper S. That is, it may be said that the image is composed of the plurality of dot columns.

Concrete Example of Printing Operation

Figure 6:
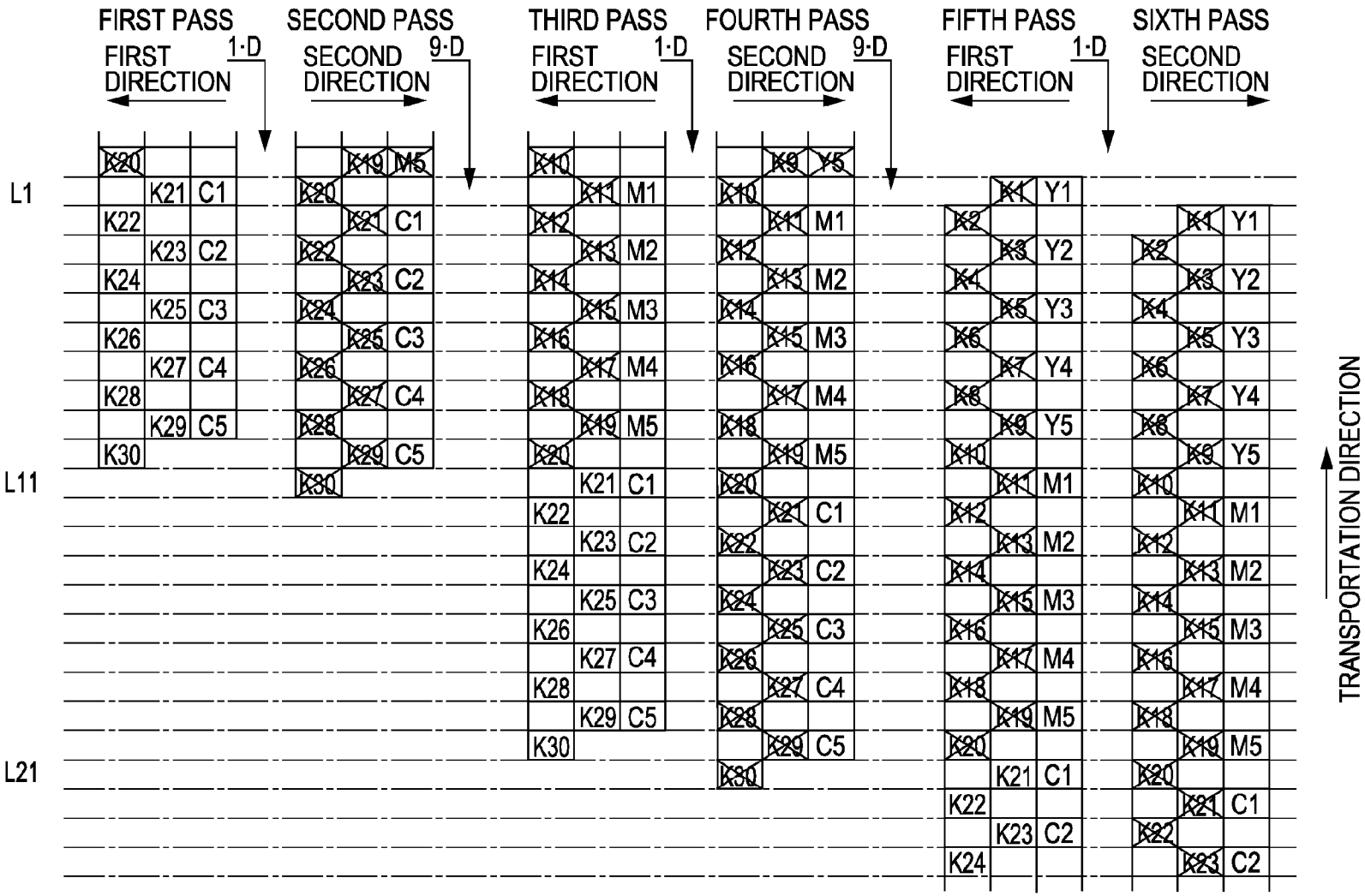
FIG. 6 is a view for explaining the printing operation using a model.
Figure 7A:
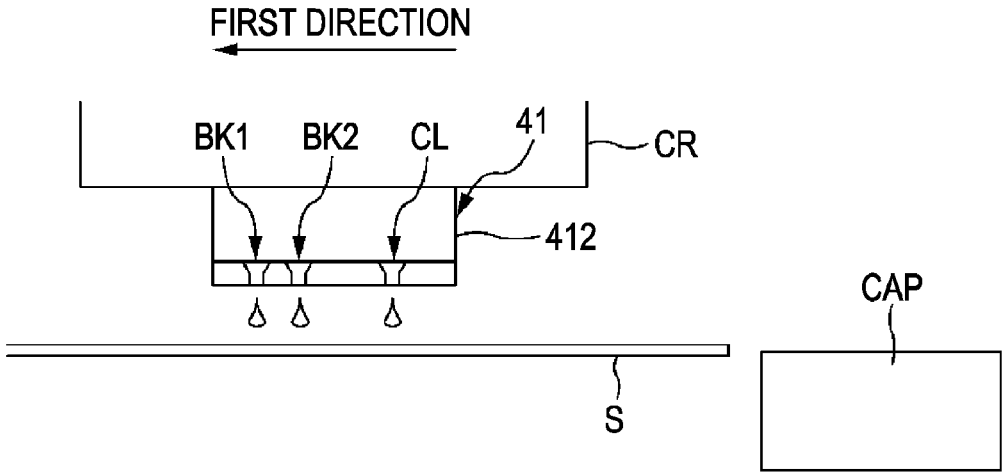
FIG. 7A is a view schematically illustrating first ink-discharging operation and FIG. 7B is a view schematically illustrating a unit region where a dot is formed by the first ink-discharging operation.
Figure 7B:
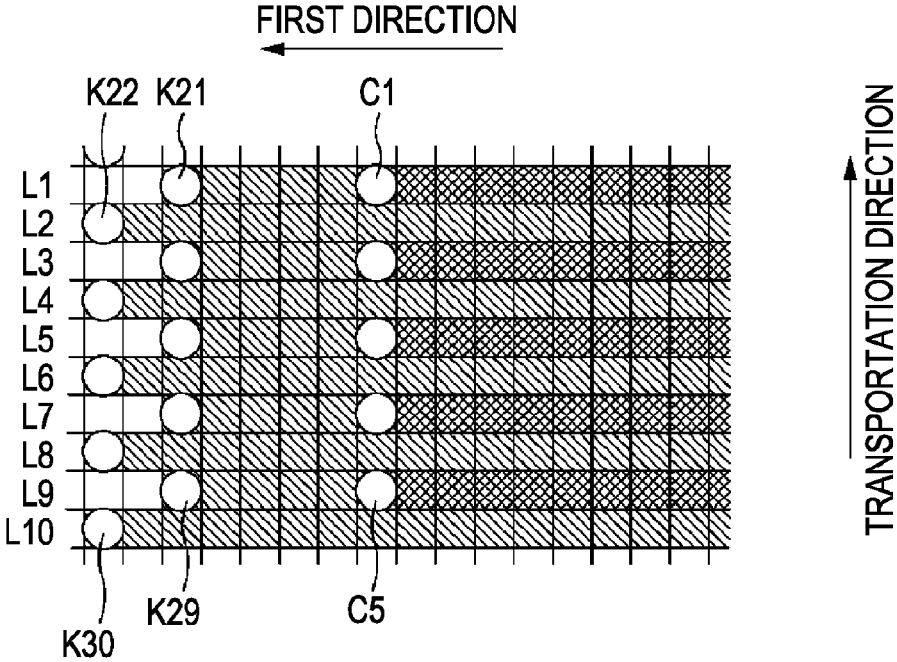
Figure 8A:
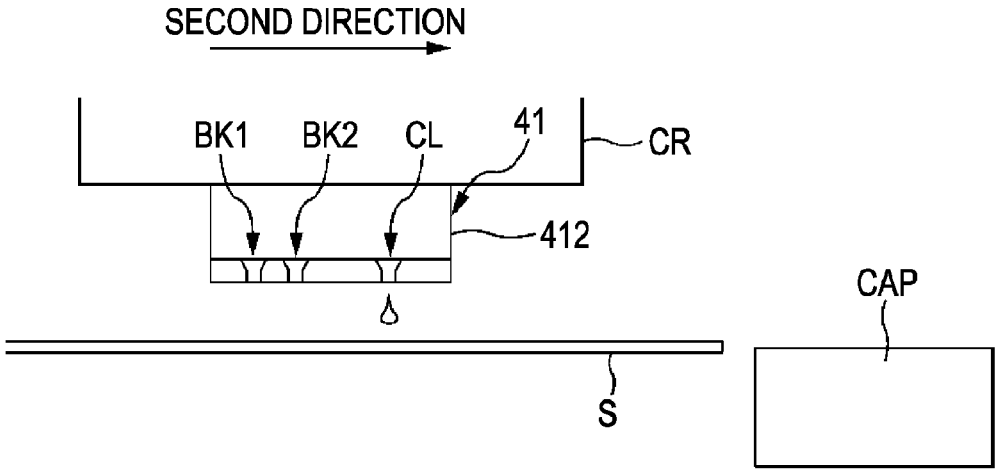
FIG. 8A is a view schematically illustrating the first ink-discharging operation.
Figure 8B:
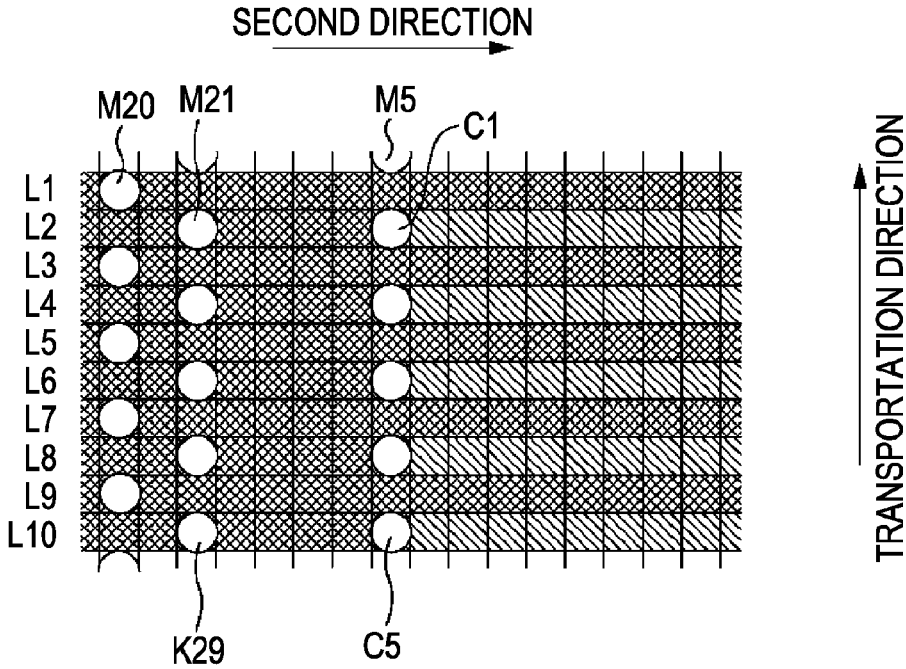
FIG. 8B is a view schematically illustrating a unit region where a dot is formed by the first ink-discharging operation.

Hereinafter, the printing operation will be described in greater detail with reference to a concrete example of color printing. Convenience of explanation, in this example shown in FIG. 6, the number of nozzles for each nozzle column is set to 15. Accordingly, each of the cyan group CG, the magenta group MG, and the yellow group YG of the color nozzle column CL includes 5 nozzles Nz. As for reference numerals denoting the nozzles Nz, smaller numerals denote closer nozzles Nz to the upstream side in the transportation direction of the paper S. From FIG. 6, it appears that the nozzles Nz move to the upstream side of the transportation direction. However, the paper S is actually transported to the downstream side in the transportation direction in the printer 1. That is, FIG. 6 shows the relative positions of the paper S and the nozzles Nz. Further, square shapes shown in FIGS. 7B and 8B are unit regions. In these figures, the size of the unit region is 1/360 inch in one edge. That is, in this concrete example, the printing is performed at resolution of 360 dpi×360 dpi (i.e. 360 dpi in the carriage traveling direction and 360 dpi in the transportation direction).

As for the paper feeding processing, the paper S is transported until one unit region block L1 of the paper S faces the first nozzle C1 of the cyan group CG. Here, the unit region block L1 refers a plurality of unit regions disposed on the most downstream side in the transportation direction. Another unit region blocks also are defined in the same manner as the unit region block L1. For example, a unit region block L2 refers a plurality of unit regions disposed on the second most downstream side in the transportation direction. That is, in the paper feeding processing, because the nozzle K21, which is the twenty first nozzle of the second black nozzle column, is located at the same position in the transportation direction as the nozzle C1, the nozzle K21 faces the unit region block L1 like the nozzle C1.

In this state, the dot forming operation of a first pass is performed. At this time, as shown in FIG. 7A, the head 41 travels from the capping member CAP (home position), which is a first end of the printer 1, to a second end (opposite end) of the printer 1. That is, the head 41 travels in the first direction getting away from the capping member CAP. When the head 41 travels in the first direction, the first black nozzle column BK1 is disposed on the front side with respect to the second black nozzle column BK2 and the color nozzle color CL in an advancing direction of the head 41. In the similar manner, the second black nozzle column BK2 is disposed on the front side with respect to the color nozzle column CL in the advancing direction of the head 41. As previously described, when the head 41 travels in the first direction, the first ink-discharging operation is performed. During the first ink-discharging operation, the black nozzle columns BK1 and BK2 (black nozzle block) and the color nozzle column CL (color nozzle block) discharge ink from the nozzles Nz thereof. Accordingly, in the case in which the black ink and the color ink overstrike the same unit region, a dot of black ink is formed first, and a dot of color ink is then formed. In the example shown in FIG. 7B, of the unit region blocks L1 to L10 on which dots are to be formed, dots of black ink are first formed at odd-numbered unit region blocks L1, L3, L5, L7, and L9, and then dots of cyan ink are formed. In this manner, in the case in which the dots of black ink and the dots of color ink are formed to overlap, if the dots of black ink are formed first and then the dots of color ink are formed, it is possible to obtain better the color shade as compared to the case in which the dots of black ink and the dots of color ink are formed in the reverse order. This is because it is believed that the ink which strikes the paper S at the last more powerfully affects the color of the dot.

In the first ink-discharging operation, a distance between the nozzles Nz of the first black nozzle column BK1 and the nozzles Nz of the second black nozzle column BK2 in the carriage traveling direction is set to be an integer multiple of print resolution. Thanks to this structure, if the nozzles Nz of the first black nozzle column BK1 face certain unit regions, the nozzles Nz of the second black nozzle column BK2 face different unit regions. In the example shown in FIG. 7B, at timing in which the nozzles Nz of the first black nozzle column BK1 face certain unit regions, the nozzles Nz of the second black nozzle BK2 face the second previous unit regions in the advancing direction. In such a manner, it is possible to synchronize control timings of ink-discharging of the nozzles Nz of the first black nozzle column BK1 and the nozzles Nz of the second black nozzle column BK2. For example, it is possible to control the timings of ink-discharging using a shared timing signal (a latch signal for latching dot forming data). As a result, ink-discharging control becomes simpler. In the similar manner, a distance between the nozzles Nz of the second black nozzle column BK2 and the nozzles Nz of the color nozzle column CL in the carriage traveling direction is also set to be an integer multiple of the print resolution. Thanks to this structure, when the nozzles Nz of the second black nozzle column BK2 face certain unit regions, the nozzles Nz of the color nozzle column CL face different unit regions. In the example shown in FIG. 7B, at timing in which the nozzles Nz of the second black nozzle column BK2 face certain unit regions, the nozzles Nz of the color nozzle column CL face the fifth previous unit regions in the advancing direction. Accordingly, with respect to the nozzles Nz of the second nozzle column BK2 and the nozzles Nz of the color nozzle column CL, the ink-discharging control becomes simpler.

Further, in the head 41, a distance between the second black nozzle column BK2 and the color nozzle column CL in the carriage traveling direction is set to be larger than that between the first black nozzle column BK1 and the second black nozzle column BK2 in the carriage traveling direction. By such a layout, with respect to the black ink discharged from the first and second black nozzle columns BK1 and BK2, it is possible to shorten a time gap between timings in which the black ink discharged from the first black nozzle column BK1 strikes the paper S and in which the black ink discharged from the second black nozzle column BK2 strikes the paper S. Further, with respect to the color ink, it is possible to enable the color ink to strike the paper S after a sufficiently long time which is required since the black ink strikes the paper S. That is, this method suppresses color mixture of the black ink and the color ink while enabling the black inks from the first black nozzle column BK1 and the second black nozzle column BK2 to be simultaneously absorbed into the paper S, which leads to improvement of the quality of a picture.

After the dot forming operation (first ink-discharging operation) of the first pass is finished, the first transporting operation is performed. In the first transporting operation, the paper S is transported by a pitch smaller than the nozzle pitch of the color nozzle column CL. Accordingly, the nozzles Nz of the color nozzle column CL come to face the unit region block where dots of color ink are not formed by the first ink-discharging operation. In this concrete example, as shown in FIG. 6, the nozzle pitch of the color nozzle column CL is equal to 2·D (D: print resolution), and the paper S is transported by the half of the nozzle pitch, 1·D. As a result, as shown in FIG. 8B, the nozzles C1 to C5 of the cyan group CG face even-numbered unit region blocks L2, L4, L6, L8, and L10 of the unit region blocks L1 to L10 which are objects on which dots are formed.

After the first transporting operation is finished, the dot forming operation of the second pass is performed. At this time, as shown in FIG. 8A, the head 41 travels from the second end of the printer 1 to the capping member CAP. In other words, the head 41 travels in the second direction approaching the capping member CAP. When the head 41 travels in the second direction, the second dot forming operation is performed. In the second dot forming operation, black ink is not discharged but color ink is discharged. By such a method, it is possible to form dots of color ink at regions where dots of color ink cannot be formed in the first ink-discharging operation. For example, dots are formed at the even-numbered unit region blocks L2, L4, L6, L8, and L10. Here, dots of black ink are formed at the even-numbered unit region blocks L2, L4, L6, L8, and L10 in the previous first ink-discharging operation. As a result, in the case of the overstrike of the black ink and the color ink, after dots of black ink are formed first, and dots of color ink are then formed. Accordingly, it is possible to regulate the color shade at the odd-numbered unit region blocks L1, L3, L5, L7, and L9 where the overstrike of dots of black ink and dots of color ink is performed by the first ink-discharging operation and at the even-numbered unit region blocks L2, L4, L6, L8, and L10 where dots of color ink are formed by the second ink-discharging operation. As a result, it is possible to improve the quality of a picture.

On the other hand, in the printer 1, the nozzle pitch of the black nozzle block comprised of the first black nozzle column BK1 and the second black nozzle column BK2 in the transportation direction is 1/360 inch (corresponding to the first predetermined pitch). Further, the nozzle pitch of the color nozzle block comprised of the color nozzle column CL in the transportation direction is 1/180 inch (corresponding to the second predetermined pitch). That is, the nozzle pitch of the color nozzle block is two times the nozzle pitch of the black nozzle block. In addition, the paper S is transported by a distance corresponding to the half of the nozzle pitch of the color nozzle block. Further, one time of the first transporting operation and one time of the second ink-discharging operation are performed in the case in which one time of the first ink-discharging operation is performed. As a result, it is possible to form dots at all the unit region blocks while obviating useless traveling of the head 41 (for example, traveling which is not accompanied with ink-discharging) and thus it is possible to effectively print an image and to easily control the ink-discharging.

After the dot forming operation (second ink-discharging operation) of the second pass is finished, the second transporting operation is performed. In the second transporting operation, the paper S is transported by a distance corresponding to the width of one group of the color nozzle column CL. Accordingly, the second group from the uppermost stream side in the transportation direction faces a region where dots of color ink are formed by the previous second ink-discharging operation (i.e. Where the group on the uppermost stream side in the transportation direction formed dots by the previous first ink-discharging operation). Further, the group on the uppermost stream side in the transportation direction and the corresponding plurality of black nozzles Nz face a next object region of the paper S. In the concrete example, as shown in FIG. 6, the paper S is transported by 9·D by the second transporting operation. Thus, the nozzles M1 to M5 of the magenta group MG come to face the odd-numbered unit region blocks L1, L3, L5, L7, and L9 of the unit region blocks L1 to L10 which are dot forming objects. Further, the nozzles K21 to K30 of the black nozzle block come to face the unit region blocks L11 to L20 which are the dot forming objects. Further, the nozzles C1 to C5 of the cyan group CG come to face the odd-numbered unit region blocks L11, L13, L15, L17, and L19 of the unit region blocks L11 to L20 which are the dot forming objects.

After the second transporting operation is finished, the dot forming operation of the third pass is performed. At this time, because the head 41 travels in the first direction, the first dot forming operation is performed. In this first dot forming operation, the nozzles K21 to K30 form dots of black ink at the unit region blocks L11 to L20, the nozzles C1 to C5 form dots of cyan ink at the odd-numbered unit region blocks L11, L13, L15, L17, and L19, and the nozzles M1 to M5 form dots of magenta ink at the odd-numbered unit region blocks L1, L3, L5, L7, and L9. Thus, of the unit region blocks L1 to L10, dots of magenta ink are formed at the odd-numbered unit region blocks L1, L3, L5, L7, and L9. Further, of the unit region blocks L11 to L20, dots of black ink and dots of cyan ink are formed at the odd-numbered unit region blocks L11, L13, L15, L17, and L19, and dots of black ink are formed at the even-numbered unit region blocks L12, L14, L16, L18, and L20.

After the dot forming operation (the first ink-discharging operation) of the third pass is finished, the first transporting operation is performed. In this first transporting operation, the paper S is transported by 1·D. Thanks to such a process, of the unit region blocks L1 to L10 which are dot forming objects, the nozzles M1 to M5 of the magenta group MG come to face the even-numbered unit region blocks L2, L4, L6, L8, and L10. Further, the nozzles C1 to C5 of the cyan group CG come to face the even-numbered unit region blocks L12, L14, L16, L18, and L20 of the unit region blocks L11 to L20 which are dot forming objects.

After the first transporting operation is finished, the dot forming operation of the fourth pass is performed. At this time, the head 41 travels in the second direction and thus the second dot forming operation is performed. In the second dot forming operation, black ink is not discharged and only color ink is discharged. In the concrete example, the even-numbered unit region blocks L2, L4, L6, L8, and L10 are provided with dots of magenta ink and the even-numbered unit region blocks L12, L14, L16, L18, and L20 are provided with dots of cyan ink.

After that, the transporting operation and the dot forming operation are repeated in the similar manner as described above. In simple language, the yellow group YG faces the odd-numbered unit region blocks L1, L3, L5, L7, and L9 and the magenta group MG faces the odd-numbered unit region blocks L11, L13, L15, L17, and L19 by employing the second transporting operation. Thus, in the dot forming operation of the fifth pass, dots are formed at the corresponding unit region blocks. Subsequently, the second transporting operation and the dot forming operation of the sixth pass are performed, and dots of color ink are formed at the even-numbered unit region blocks.

Figure 9A:
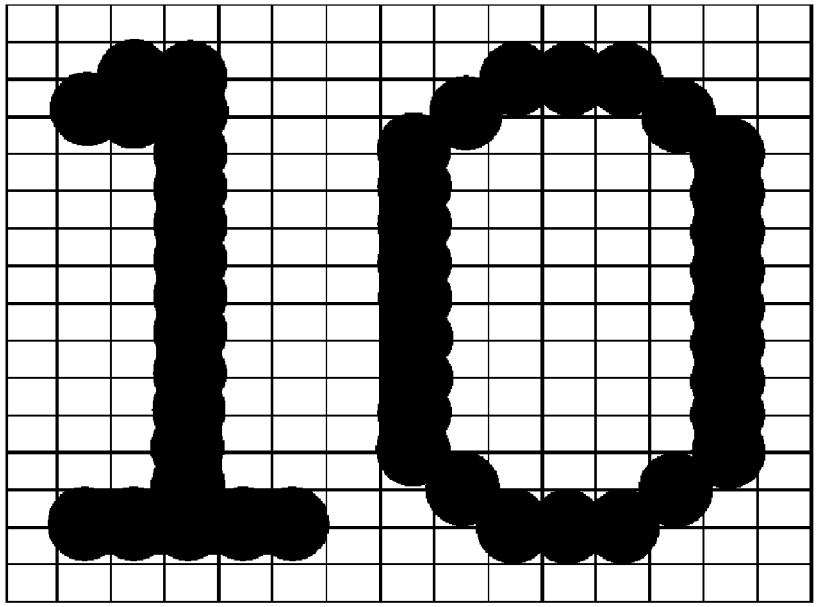
FIG. 9A is a view illustrating printed text letters formed by a printing method according to one embodiment of the invention and FIG. 9B is a view illustrating printed text letters formed by a comparative printing method.
Figure 9B:
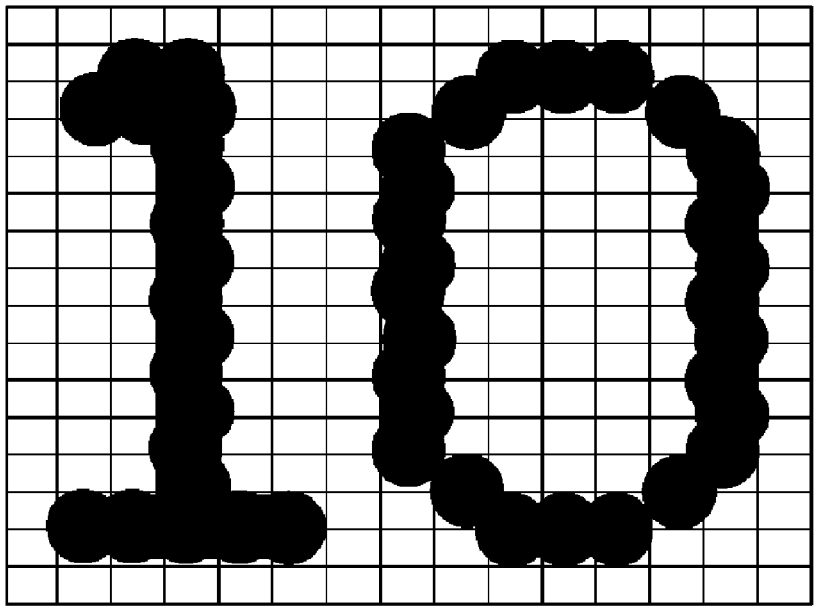

By performing printing in the above-described order, with respect to black ink mainly used in a text image including letters and numerals and a line image, dots of black ink are formed at higher resolution (360 dpi in the concrete example) than that of dots of color ink formed in the dot forming operations of odd-numbered passes, but dots of black ink are not formed in the dot forming operations of even-numbered passes. Accordingly, it is possible to improve the quality of the text image. It is believed that displacement of striking positions of dots is suppressed to the minimum. For example, as shown in FIG. 9A, if the dots of black ink are formed by only the first direction traveling of the head, the variation of positions of dots is suppressed and thus it is possible to print the text image at high quality. On the other hand, as shown by the comparative example in FIG. 9B, in the case in which the dots are formed by both the first direction traveling of the head 41 and the second direction traveling of the head 41, the positions of the dots formed during the first direction traveling of the head 41 and during the second direction traveling of the head 42 are misaligned in the traveling direction, and thus become different from each other, which results in image distortion as a whole. In conclusion, it is possible to improve the quality of a text image by employing the above-mentioned printing method.

By performing printing in the above-described order, the sequence of forming the dots becomes regular in the case of expressing a color by the overstrike of inks at a certain unit region. That is, it is possible to form dots of black ink, cyan ink, magenta ink, and yellow ink in this order. Thanks to the method, it is possible to suppress the variation of the color shade all over the unit regions. In addition, because the yellow ink is most easily affected by color mixture, dots of yellow ink are formed at the last. For this reason, it is possible to suppress effect of color mixture to the minimum. In addition, taking the color mixture of yellow ink into consideration, dots of black ink which the most powerfully affects the color mixture of yellow ink are set to be formed in the first stage and dots of cyan ink which the second most powerfully affects the color mixture of yellow ink are set to be formed at the second stage. This point also leads to suppression of the color mixture effect.

The black nozzle block of the head 41 is formed at a small nozzle pitch of 1/360 inch which is smaller than the nozzle pitch of the color nozzle column CL in the transportation direction of the paper S. In addition, the same color of ink is discharged over the full length of the paper S in the transportation direction of the paper S. Accordingly, it is possible to print an image at higher resolution and speed than a known head (in which nozzles are arranged in a manner such that one color of ink corresponds to one nozzle) for the black ink printing. The advantageous effect is particularly remarkable for a text print using graphics.

Another Embodiment

The above embodiment is described mainly with reference to the printer 1 as a printing device but also refers printing methods and control programs. In addition, the embodiment also discloses an ink jet application technique such as a printing method (pixel forming method or process) performed when forming pixels of a liquid crystal display device 120. Further, the embodiment is described for helping better understanding of the invention and thus must not be construed to limit the invention. Further, those skilled in the art will appreciate that various modifications, additions and substitutions of the invention are possible, without departing from the scope and spirit of the invention as disclosed in the accompanying claims, and also the invention includes equivalent thereof. Further, the following embodiments are also included in the invention.

Structure of Nozzles

In the above-described embodiment, the black nozzle block includes two black nozzle columns and the color nozzle block includes one color nozzle column CL, but the nozzle structure is not limited thereof. For example, the black nozzle block may include four black nozzle columns, each column being shifted from one another by the quarter (¼) of the nozzle pitch in the transportation direction, and the color nozzle block includes two nozzle columns CL, nozzles Nz of which are shifted from each other by the half (½) of the nozzle pitch in the transportation direction. Further, the color nozzle column CL may be structured so as to discharge five kinds of color ink including light cyan ink and light magenta ink, or to discharge red ink and violet ink. Further, the first black nozzle column BK1 and the second nozzle column BK2 may be replaced with each other. That is, the first black nozzle column BK1 and the color nozzle column CL are arranged relatively close to each other and the second black nozzle column BK2 and the color nozzle column LC are arranged relatively far from each other.

Nozzle Pitch of Color Nozzle Block

It is preferable that the nozzle pitch of the color nozzle block is an even-numbered multiple (2 n: n is a natural number equal to or larger than one) of the nozzle pitch of the black nozzle block. This is because it is possible to obviate useless traveling of the head 41 and effectively perform printing of an image. Here, in the case in which n is 2 or more, the paper S is transported in a manner such that the relative position of the nozzles Nz of the plurality of the color nozzle block and the paper S in the transportation direction is shifted by a distance corresponding to ½ n of the nozzle pitch of the color nozzle block. Further, it is possible to obviate useless traveling of the head 41 by alternately performing different second ink-discharging operations of discharging only color ink while moving the head 41 in the first direction and the above-mentioned second ink-discharging operations, and to effectively print an image.

Printing Method

According to one printing method, black ink and color ink are discharged while the head 41 travels in the first direction, and color ink is discharged while the head 41 travels in the second direction. However, different printing methods are also possible. For example, a printing method, in which a plurality of nozzles Nz corresponds to one unit region block in the color nozzle column CL, may be employed.

What is claimed is:

1. An ink jet printer, comprising:

an ink jet head comprising a first black nozzle column including a plurality of nozzles, a second black nozzle column including a plurality of nozzles and a color nozzle column including a plurality of nozzles; and a carriage that equips with the ink jet head, the carriage moving from a first side to a second side and from the second side to the first side;

wherein the first black nozzle column discharges the black ink while the carriage is moving from the first side to the second side and does not discharge the black ink while the carriage is moving from the second side to the first side;

wherein the second black nozzle column discharges the black ink while the carriage is moving from the first side to the second side and does not discharge the black ink while the carriage is moving from the second side to the first side; and wherein the single color nozzle column discharges the different colors of ink while the carriage is moving from the first side to the second side and from the second side to the first side.

2. The ink jet head according to claim 1, wherein the plurality of nozzles of the second black nozzle column are formed at positions shifted from the plurality of nozzles of the first black nozzle column in the transportation direction at a pitch which is the half of the predetermined pitch.

3. The ink jet head according to claim 1, wherein the color nozzle column includes a cyan group discharging cyan ink, a magenta group discharging magenta ink, and a yellow group discharging yellow ink.

4. The ink jet head according to claim 3, wherein each of the magenta group and the yellow group includes the same number of nozzles as the cyan group.

5. The ink jet head according to claim 3, wherein the cyan group is disposed at a position on the upstream side of the transportation direction with respect to the magenta group and the yellow group.

6. The ink jet head according to claim 3, wherein the yellow group is disposed at a position on the downstream side of the transportation direction with respect to the cyan group and the magenta group.

7. The ink jet head according to claim 1, wherein the plurality of nozzles of the second black nozzle column are formed at positions shifted from the plurality of nozzles of the first black nozzle column in a transverse direction perpendicular to the transportation direction by a distance corresponding to an integer multiple of print resolution.

8. The ink jet head according to claim 1, wherein the plurality of nozzles of the color nozzle column are formed at positions shifted from the plurality of nozzles of the second black nozzle column in a transverse direction perpendicular to the transportation direction by a distance corresponding to an integer multiple of print resolution.

9. The ink jet head according to claim 1, wherein the plurality of nozzles of the second black nozzle column are formed at positions shifted from the plurality of nozzles of the first black nozzle column in a transverse direction perpendicular to the transportation direction by a distance which corresponds to an integer multiple of print resolution, and wherein the plurality of nozzles of the color nozzle column are formed at positions shifted from the plurality of nozzles of the second black nozzle column by a distance which corresponds to an integer multiple of print resolution and which is larger than a distance between the plurality of nozzles of the first black nozzle column and the plurality of nozzles of the second black nozzle column in the transverse direction.

10. An ink jet printer, comprising:

an ink jet head including a first black nozzle column, a second black nozzle column and a color nozzle column; and a carriage that equips with the ink jet head, the carriage moving from a first side to a second side and from the second side to the first side;

wherein the first black nozzle column has a plurality of nozzles arranged at a predetermined pitch in a transportation direction of a medium, the first black nozzle column discharging black ink while the carriage is moving from the first side to the second side and not discharging the black ink while the carriage is moving from the second side to the first side;

wherein the second black nozzle column has a plurality of nozzles arranged at the predetermined pitch in the transportation direction and located at positions shifted from the plurality of nozzles of the first black nozzle column in the transportation direction, the second black nozzle column discharging the black ink while the carriage is moving from the first side to the second side and not discharging the black ink while the carriage is moving from the second side to the first side; and wherein the color nozzle column has a plurality of nozzles arranged at the predetermined pitch in the transportation direction and located at the same positions as the plurality of nozzles of the second black nozzle column in the transportation direction, the color nozzle column discharging different colors of ink from different groups of nozzles thereof while the carriage is moving from the first side to the second side and from the second side to the first side, each group including a predetermined number of nozzles consecutively disposed in the transportation direction.

* * * * *

UNITED STATES PATENT AND TRADEMARK OFFICE

CERTIFICATE OF CORRECTION

PATENT NO. : 8,070,256 B2
APPLICATION NO. : 11/959312
DATED : December 6, 2011
INVENTOR(S) : Naoki Sudo et al.

It is certified that error appears in the above-identified patent and that said Letters Patent is hereby corrected as shown below:

Title page, left hand column, Item (12)
Change "Sudo" to --Sudo et al.--

Title page, left hand column, Item (75)
After Naoki Sudo, Matsumoto (JP), add
Hirokazu Nunokawa, Matsumoto (JP)

Signed and Sealed this
Twenty-ninth Day of May, 2012

David J. Kappos

David J. Kappos
*Director of the United States Patent and Trademark Office*